US006678971B2

(12) United States Patent
Brooks

(10) Patent No.: US 6,678,971 B2
(45) Date of Patent: Jan. 20, 2004

(54) PEDICURE SANDAL

(76) Inventor: Marian J. Brooks, 6833 Willow Creek Run, Lake Worth, FL (US) 33363

( * ) Notice: Subject to any disclaimer, the term of this patent is extended or adjusted under 35 U.S.C. 154(b) by 23 days.

(21) Appl. No.: 10/061,787

(22) Filed: Feb. 4, 2002

(65) Prior Publication Data

US 2003/0145492 A1 Aug. 7, 2003

(51) Int. Cl.[7] ..... A43B 7/26
(52) U.S. Cl. ..... 36/94; 36/11.5
(58) Field of Search ..... 36/94, 11.5, 95; D28/56

(56) References Cited

U.S. PATENT DOCUMENTS

| | | | | | |
|---|---|---|---|---|---|
| 2,506,308 | A | * | 5/1950 | Maynier | 602/30 |
| 2,947,095 | A | * | 8/1960 | Miyachi | 36/11.5 |
| 3,011,281 | A | * | 12/1961 | King | 36/11.5 |
| 3,299,893 | A | * | 1/1967 | Collina | 36/140 |
| 4,017,987 | A | | 4/1977 | Perez | |
| 4,207,880 | A | | 6/1980 | Zinkovich | |
| D260,047 | S | * | 8/1981 | Heinz | 36/11.5 |
| D271,156 | S | * | 11/1983 | Williamson | 36/11.5 |
| 4,419,836 | A | * | 12/1983 | Wong | 36/11.5 |
| D306,084 | S | * | 2/1990 | Volz et al. | D28/61 |
| 5,870,837 | A | | 2/1999 | Poulos | |
| 5,893,221 | A | * | 4/1999 | Weissman et al. | 36/91 |
| D420,785 | S | * | 2/2000 | Perez | D2/916 |
| 6,226,893 | B1 | | 5/2001 | Schlamp et al. | |
| 6,298,580 | B1 | | 10/2001 | Tadayan | |

* cited by examiner

*Primary Examiner*—Ted Kavanaugh
(74) *Attorney, Agent, or Firm*—Melvin K. Silverman

(57) ABSTRACT

A pedicure sandal employs a base formed of a resilient elastomeric material, the base inclusive of a cushioned upper surface thereof, a toe-separating structure, and a bottom surface for providing ground and floor resistance against slippage. The sandal more particularly defines an outer perimeter of the base generally shaped to accommodate a human foot, in which the perimeter includes a bulge at an anterior lateral region which is adjacent to the lateral-most or small toe of the foot of a user. The toe-separating structure includes three flexible elastomeric vertical substantially T-shaped posts, each of which include a plug-like bottom end for engagement with the bottom surface of the sandal, a toe-separating elongate neck, integral with the bottom end of each post, and proportioned for engagement with vertical toe-positioning channels within said sandal base, and a flat upper surface, integral to the neck, having a primary axis substantially transverse to a directionality of separations between adjacent pair of toes that each respective elongate neck separates from each other. The axis of the upper surface exhibits a length sufficient to more than a bridge the separation between pairs of toes.

15 Claims, 4 Drawing Sheets

PEDICURE SANDAL

BACKGROUND OF THE INVENTION

1. Field of the Invention

This invention relates generally to footwear and, more particularly, to an improved sandal having utility both for purposes of pedicure and for walking in general.

2. Prior Art

A sandal-type footwear, has its origin in ancient times, however, today is more commonly used in informal settings, such as the home or beach, to protect an individual's feet. Further, sandals are used to assist a pedicurist during a pedicure as, for example, is represented in various prior art including U.S. Pat. No. 4,017,987 (1977) to Perez; U.S. Pat. No. 5,870,837 (1993) to Poulos; U.S. Pat. No. 6,226,893 (2001) to Schlamp, et al, and U.S. Pat. No. 6,298,580 (2001) to Tadayan. All such pedicure sandals have, of necessity, certain common features which include a resilient base, a toe-separating structure and some means to assure stability of the ankle relative to the base of the sandal. An objective of all pedicure sandals is to assist the pedicurist in performing the pedicure by inhibiting the toes from touching each other which while, concurrently, simplifying the task of proper application of nail polish to each toe. A further goal of some sandals has also been to enable the individual/client receiving the pedicure to immediately walk or to drive a car with freshly nail polished toes, thus eliminating the need for waiting possibly up to an hour at the salon while the nail polish dries. However, as is well known to individuals who obtain pedicures, even if the polish dries within such a period of about an hour, the polish can still easily scratch should the individual apply put on tight fitting shoes or inadvertently come into contact with another surface before the polish has cured to its final density.

As such, the prior art, as reflected in the above, has attempted to address said problems by providing different types of toe-separating structures to increase the distance between each toe thereby making less difficult the beautician's task of applying polish to one toe without interfering with the drying process of another toe to which polish has already been applied. A further issue is that the structure of many prior art sandals which seek to address the above problems are not acceptable for use by pedicurist who, generally prefers to employ a special purpose toe separator, readily available at a beauty supply store, or to use the historic method of placing wads of cotton between each toe of the client. Pedicurists also have had reservations relative to the use of pedicure sandals after the polish application process because the client, after completion of the process, must place her foot through a fixed strap and then insert vertical elements of the toe separating structure between the respective polished toes. Therein, any incorrect or deviant movement of the client will cause the nail polish of the completed toes to be affected. As such, the need for a pedicure sandal which is acceptable to the pedicurist, and which is functional to the client wishing to leave the salon prior to an hour after the polish has been applied or wishes to wear regular shoes before the polish is totally cured. Accordingly, the instant invention responds to the long felt need for a pedicure sandal more responsive to the needs and requirements of the pedicurist as well as the client.

It has also been the case that, apart from the above set forth needs stressed by the prior art, no conscious effort has apparently even been made in this area to provide an ergonomic sandal, i.e., one which not only addresses the above pedicure requirements but, as well, takes into consideration certain physiologic requirements of the human foot for purposes of walking, this including among other factors, the stability of the ankle relative to the base of the sandal itself.

SUMMARY OF THE INVENTION

The inventive pedicure sandal employs a base formed of a resilient elastomeric material, said base inclusive of a cushioned upper surface thereof, a toe-separating structure, and a bottom surface for providing ground and floor resistance against slippage. The within sandal more particularly comprises an outer perimeter of said base generally shaped to accommodate a human foot, in which the perimeter thereof includes a bulge at an anterior lateral region thereof which is adjacent to the lateral-most or small toe of the foot of a user. Said toe-separating structure comprises three flexible elastomeric vertical substantially T-shaped posts, each of which comprise (i) a plug-like bottom end for engagement with said bottom surface of the sandal, (ii) a toe-separating elongate neck, integral with said bottom end of each post, and proportioned for engagement with vertical toe-positioning channels within said sandal base, and (iii) a flat upper surface, integral to said neck, having a primary axis substantially transverse to a directionality of separations between adjacent pair of toes that each respective elongate neck separates from each other. Said axis exhibits a length sufficient to more than a bridge said separation between pairs of toes. At a portion of said neck, integral with said flat upper surface of each post, there is defined a transition zone between each respective upper surface and said neck which, in vertical cross-section, defines a mushroom-like geometry comprising opposing symmetric curves as said geometry approaches said upper surface to thereby increase said toe separation substantially beyond that of a horizontal width of each neck of each post. Said transition zone also substantially envelops the dorsal side of each toe to thereby increase toe stability within the toe-separating structure. Said toe separation structure also defines what has been determined to be an ergonomic relationship between the positioning of the three smallest toes relative to the two largest toes, taken both alone and in combination with the position of strap means for securement of the foot relative to the base of the sandal.

It is accordingly an object of the invention to provide a pedicure sandal having improved utility both for purposes of pedicure within a salon and for purposes of use in an ordinary and conventional manner outside of the salon.

It is another object to provide a sandal of the above type to provide enhanced comfort and stabilization of the toes and foot relative to the base of the sandal.

It is a still further object of the invention to provide a pedicure sandal of the above type, while providing sufficient separation between the toes of the user to satisfy traditional concerns of the pedicurist relative to inadvertent scratching of the polish from a completed toenail before the polish thereof has fully cured.

It is a still further object to provide a pedicure sandal of the above type that may be cost-effectively manufactured using, as the initial piece in a production process, a conventional shower or beach sandal (also known as a flip flop).

The above and yet other objects and advantages of the present invention will become apparent from the hereinafter set forth Brief Description of the Drawings and Detailed Description of the Invention.

DETAILED DESCRIPTION OF THE INVENTION

Figure 1:
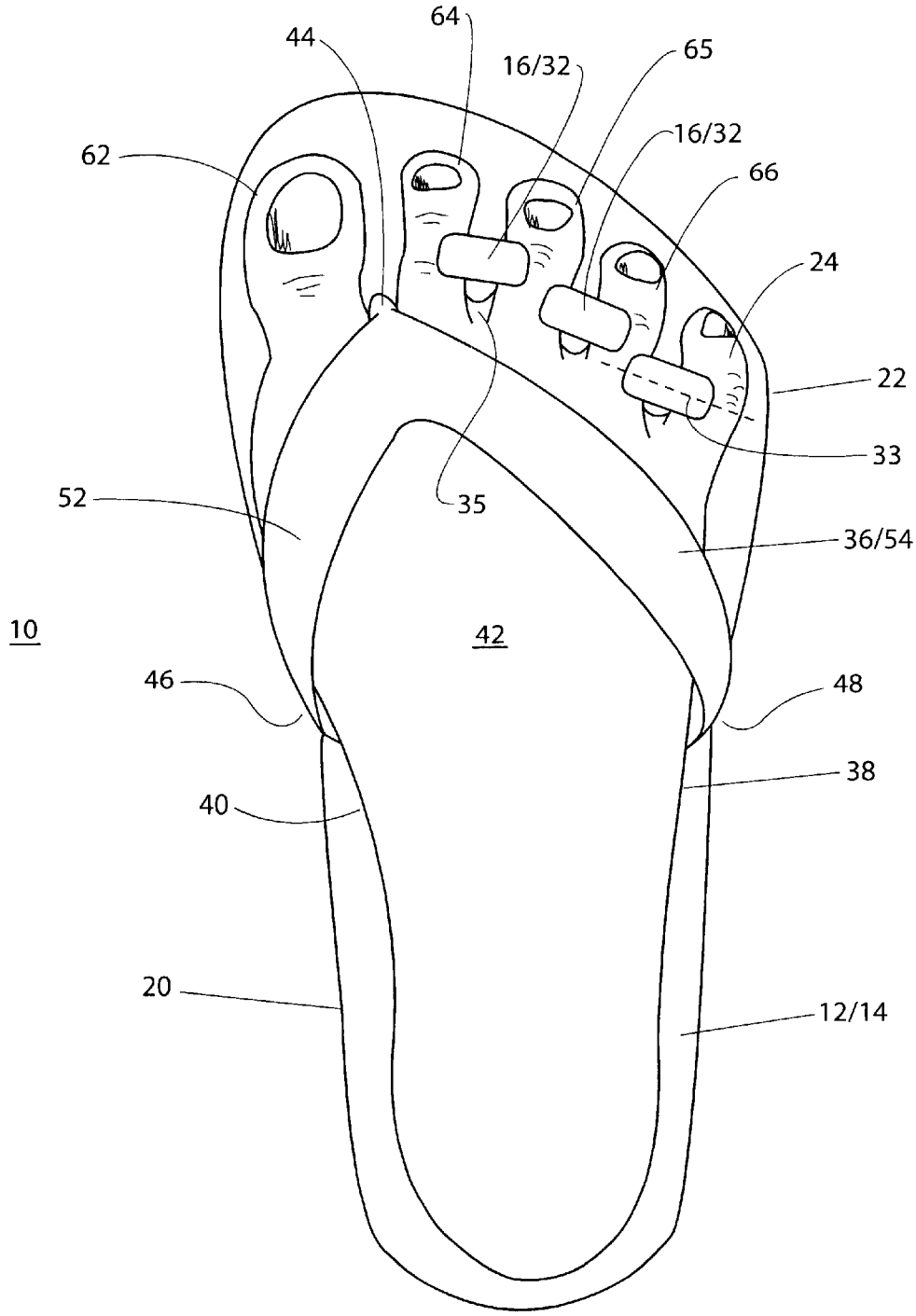
FIG. 1 is a top plan view of the inventive pedicure sandal, inclusive of the foot of a user thereof.
Figure 2:
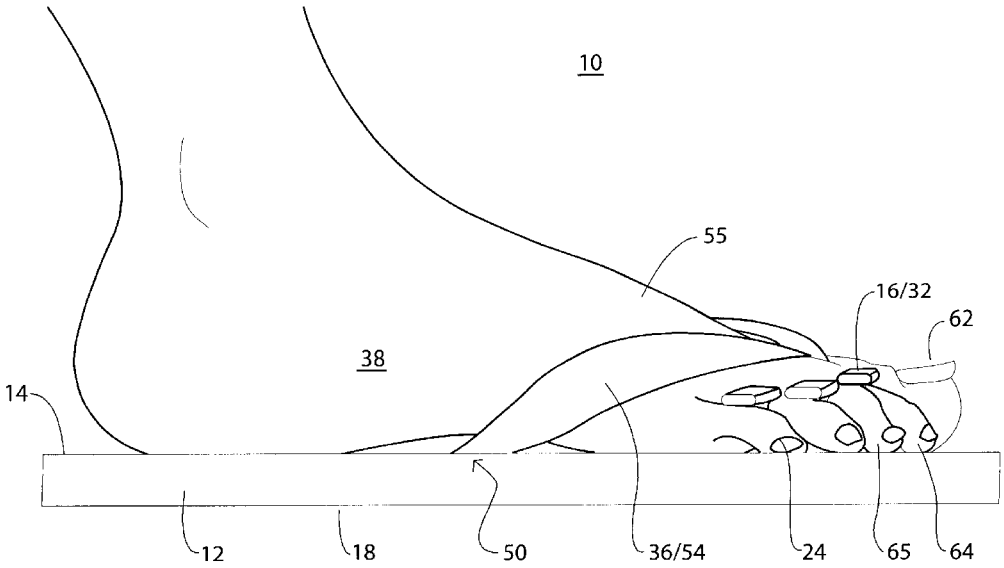
FIG. 2 is a side elevational view of the sandal and foot of FIG. 1.
Figure 3:
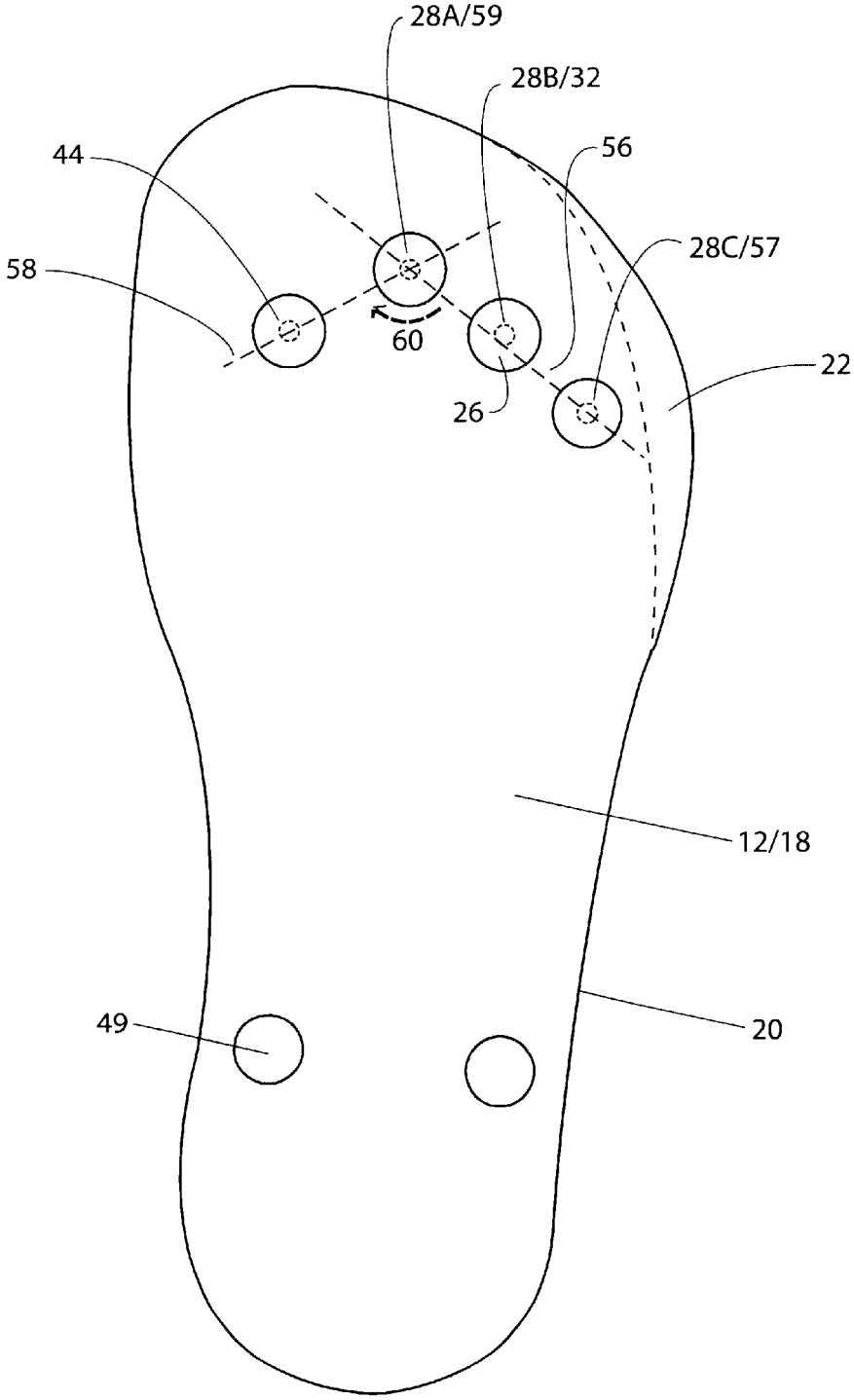
FIG. 3 is a bottom plan view of the bottom surface of the inventive pedicure sandal.

With regard to the respective top, side and bottom views of FIGS. 1, 2, and 3, the instant pedicure sandal 10 may be seen to include a base 12 which is formed of a resilient elastomeric or rubber type material. The base 12 includes of a cushioned upper surface 14, a toe-separating structure including posts 16 and a bottom surface 18 for providing ground and floor resistance against slippage by a user of the sandal and which, further, may be seen to include an outer perimeter 20 of said base 12 which includes a bulge 22 at an anterior lateral region of said base and which is therefore adjacent to a lateral-most toe 24 (commonly termed the small toe) of the user. This provides enhanced distance for greater spacing between all toes, as is set forth below, and protection of said toe 24 during walking.

Figure 4:
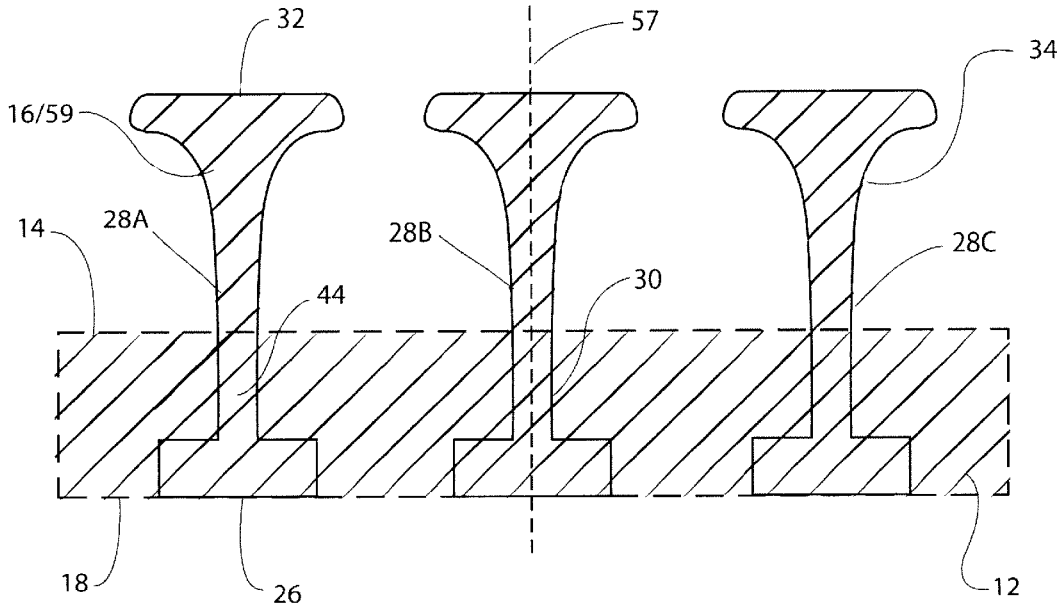
FIG. 4 is a vertical cross-sectional view taken through the toe-separating structure of the instant invention.

In FIG. 4, said toe-separating structure may be seen to more particularly comprise three resilient vertically positioned substantially T-shaped posts 16, each of which include an enlarged plug-like bottom end 26 for engagement of said bottom surface 18 of the sandal, elongate necks 28A–28C which are proportioned for frictional engagement within toe positioning channels 30 (shown in phantom in FIG. 3) within said sandal base 20. Posts 16 also include a flat upper surface 32, integral with said necks 28, and having a primary axis 33 (see FIG. 1) which is substantially transverse in directionality to that of separations between adjacent pairs of toes that each respective elongate neck separates from each other. As may be noted, each flat upper surface 32 defines a substantially rectangular geometry, however, having softened or curved corners thereof. It may also be noted that each primary axis 33 of each rectangularly shaped upper surface 32 is also substantially parallel with each other.

With further reference to FIG. 4, it may be seen that said T-shaped posts 16, which define the toe-separating structure, appear mushroom-like when viewed in vertical cross-section. Further, there is defined a transition zone 34 between each neck 28 and each upper surface 32. This zone comprises opposing symmetric curves as said geometry approaches said upper surface to thereby increase said toe separation substantially beyond that of a horizontal width of each neck of each post, and thereby also increasing toe stability between said three posts. Resultant thereof, enhanced comfort and safety is provided to the user, particularly when the pedicure sandal is used for purposes of walking or driving. Further, the pedicurist is provided with stability of toe location thereby reducing the chance of scratching an already-polished toe. Also, the mushroom-like geometry of zone 34 obviates the need to force cotton or other means between the toes of the client/user of the inventive sandal.

With further regard to the views of FIGS. 1 and 2, the inventive sandal may be seen to also include strap means 36 for engaging a lateral side 38, a medial side 40 and a dorsal (top) side 42 of the foot. Said strap means 36 more particularly include an elongate vertical element 44, opposing ends 46 and 48 which are respectively secured to said base 20 at respective medial and lateral edges of the base and by plugs 49 within base 18. See FIG. 3. Between said elongate vertical element 44 and said ends 46 and 48, are dorsal straps 52 and 54 that are positioned immediately posteriorly of the toes, thereby enhancing stability of forefoot 55 relative to base 12. (See FIG. 2)

In FIG. 3 and after figures, it may be further noted that there is a first virtual line 56 which is defined by connection of the axes 57 of said necks 28 of posts 16, this being the same axis as that of said-toe positioning internal channels 30 of base 12. Further, a second virtual line 58 is defined between an axis of said vertical part 44 of said strap means 36 and neck 28*k* of a one post 59 of said three posts 16 nearest to said vertical part 44. An angle 60 therebetween typically falls within a range of about 110 to 130 degrees. Therein, the axis of neck 28B is at approximately the same anterior-posterior axis as said vertical element 44. (see FIG. 3) Such a relative positioning of largest toe 62 relative to the next two toes 64 (see also FIGS. 2 and 3) and 65, and has been found to be particularly comfortable and stable, taken in combination with strap means 36.

Figure 5:
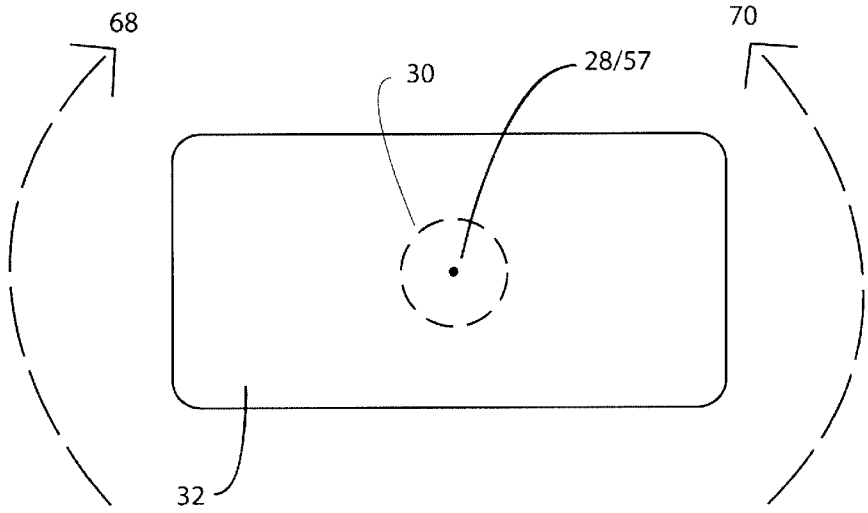
FIG. 5 is a top plan view of a single post of the toe separating structure shown in FIG. 4.

It is further noted that each post neck 28A–28B is also torsionally resilient such that either clockwise or counter-clockwise rotation 70 about axis 57 (see FIGS. 4–5) will be effected, this inclusive of each transition zone 34 between four of the five toes. Each of said post necks thereby define means for torsional rotation of at least 90 degrees clockwise and 90 degrees counterclockwise about a vertical axis defined by each neck. This feature of the invention further contributes to the utility of the pedicure sandal for dynamic and safe use external of the salon.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of the United States is:

1. A pedicure sandal, comprising:

(a) a base formed of resilient material, said base inclusive of a cushioned upper surface thereof and including outer perimeter generally shaped to accommodate a human foot, said perimeter comprising a bulge at an anterior lateral region thereof adjacent to a lateral-most toe of a foot of a user;

(b) a toe-separating structure comprising three flexible vertical substantial T-shaped posts, each comprising:

(i) a plug-like bottom end for engagement of said bottom surface of said sandal;

(ii) a toe-separating elongate neck thereof, integral with said bottom end and proportioned for engagement with vertical toe-positioning channels in said sandal; and (iii) a flat upper surface, integral to said neck, having a primary horizontal axis substantially transverse to a directionality of separations between each adjacent pair of toes, in which each respective said elongate neck separates said toes from each other, said axis having a length sufficient to at least bridge said separation between said each adjacent pair of toes; and (c) a bottom surface for providing ground and floor resistance against slippage.

2. The pedicure sandal as recited in claim 1, in which each of said upper surfaces defines a substantially rectangular geometry.

3. The sandal as recited in claim 2, in which each of said primary axes of each of said upper surfaces of said T-shaped posts is substantially parallel with each other.

4. The pedicure sandal as recited in claim 1, in which a transition zone between each respective said upper surface and integral neck of each T-shaped post defines, in vertical cross-section, a mushroom-like geometry comprising opposing symmetric curves as said geometry approaches said upper surface to thereby increase said toe separation substantially beyond that of a horizontal width of each neck of each post, and thereby also increasing toe stability between said three posts.

5. The pedicure sandal as recited in claim 1, in which vertical axes of said three elongate necks of said T-shaped posts define, in aggregate, a common line which is not co-linear with a line defined between:

(a) an elongate vertical element for separating a largest toe of said user from an adjacent and second largest toe; and (b) a vertical axis of that one of said three T-shaped posts nearest to said vertical elongate element (a) of said sandal.

6. The pedicure sandal as recited in claim 5, said sandal further comprising:

strap means for engaging lateral, medial and said dorsal sides of said foot, positioned slightly posteriorly of toes of said user, said strap means comprising:

said elongate vertical element (a) and opposing other ends of said strap means, secured respectively to said base at respective lateral and medial edges of said base, and connecting straps between said vertical element and each of said opposing other ends.

7. The sandal as recited in claim 6, in which each of said primary axes of each of said upper surfaces of said T-shaped posts are substantially parallel with each other.

8. The sandal as recited in claim 7, in which a posterior directed angle between said non co-linear lines defines a range of between about 110 and about 130 degrees.

9. The sandal as recited in claim 6, in which each of said posts are uniform in vertical height with each other and relative to said base.

10. The sandal as recited in claim 6, in which each of said integral elongate necks of said elastomeric vertical T-shaped posts comprises:

means for tortional rotation of at least ninety degrees clockwise and counterclockwise, about a vertical axis of each neck, whereby enhanced comfort to the user is effected, particularly when the user is walking with said sandal.

11. The sandal as recited in claim 6, in which a posterior directed angle between said non-co-linear lines defines a range of between about 110 and about 130 degrees.

12. The sandal as recited in claim 5, in which each of said primary axes of each of said upper surfaces of said T-shaped posts is substantially parallel with each other.

13. The sandal as recited in claim 12, in which each of said integral elongate necks of said elastomeric vertical T-shaped posts comprises:

means for tortional rotation of at least ninety degrees clockwise and counterclockwise, about a vertical axis of each neck, whereby enhanced comfort to the user is effected, particularly when the user is walking with said sandal.

14. The sandal as recited in claim 5, in which a posterior directed angle between said respective non-co-linear lines defines a range of between about 110 and 130 degrees.

15. The sandal as recited in claim 1, in which each of said integral elongate necks of said T-shaped posts comprises:

means for tortional rotation of at least ninety degrees clockwise and counterclockwise, about a vertical axis of each neck, whereby enhanced comfort to the user is effected, particularly when the user is walking with said sandal.

* * * * *